US008998739B2

(12) United States Patent
Haight et al.

(10) Patent No.: US 8,998,739 B2
(45) Date of Patent: Apr. 7, 2015

(54) SWING TRAINING DEVICE

(71) Applicant: Glow Right Golf, LLC, Deforest, WI (US)

(72) Inventors: Michael L Haight, Portland, OR (US); Benjamin A Casbarro, Portland, OR (US); Jonathan M Fritz, Deforest, WI (US)

(73) Assignee: Glow Right Golf, LLC, Madison, WI (US)

( * ) Notice: Subject to any disclaimer, the term of this patent is extended or adjusted under 35 U.S.C. 154(b) by 0 days.

(21) Appl. No.: 14/073,801

(22) Filed: Nov. 6, 2013

(65) Prior Publication Data

US 2014/0141901 A1 May 22, 2014

Related U.S. Application Data

(60) Provisional application No. 61/722,915, filed on Nov. 6, 2012.

(51) Int. Cl.

| | |
|---|---|
| ***A63B 69/36*** | (2006.01) |
| ***A63B 24/00*** | (2006.01) |
| ***A63B 15/02*** | (2006.01) |
| *A63B 71/06* | (2006.01) |

(52) U.S. Cl.

CPC ..... *A63B 69/3614* (2013.01); *A63B 24/0003* (2013.01); *A63B 69/3623* (2013.01); *A63B 15/02* (2013.01); *A63B 2071/0694* (2013.01); *A63B 2207/02* (2013.01); *A63B 2220/803* (2013.01); *A63B 2220/805* (2013.01)

(58) Field of Classification Search

USPC ..... 473/119, 220, 221, 223, 226, 278, 409

See application file for complete search history.

(56) References Cited

U.S. PATENT DOCUMENTS

| | | | | | |
|---|---|---|---|---|---|
| 4,858,934 | A * | 8/1989 | Ladick et al. | ..... | 473/220 |
| 4,971,327 | A * | 11/1990 | Rabold | ..... | 473/220 |
| 5,897,441 | A * | 4/1999 | Apthorp | ..... | 473/220 |
| 5,954,592 | A * | 9/1999 | Laffer et al. | ..... | 473/220 |
| 6,254,493 | B1 * | 7/2001 | Wurster | ..... | 473/220 |
| 6,648,769 | B2 * | 11/2003 | Lee et al. | ..... | 473/223 |
| 6,921,340 | B2 * | 7/2005 | Dickie | ..... | 473/220 |
| 7,899,408 | B1 * | 3/2011 | Balardeta et al. | ..... | 455/73 |
| 2004/0023726 | A1 * | 2/2004 | Ritson et al. | ..... | 473/220 |
| 2005/0009617 | A1 * | 1/2005 | Grossmeyer et al. | ..... | 473/220 |

* cited by examiner

*Primary Examiner* — Nini Legesse

(74) *Attorney, Agent, or Firm* — Jonathan M. Fritz

(57) ABSTRACT

A swing training system which includes a light-reactive surface, and a training device having a light source capable of striking the light-reactive surface and creating a temporary visual representation of the path of the light over the surface. The device can include multiple light sources, which according to the arrangement of the illuminated paths on the surface indicate if the proper alignment was achieved during a swing. In accordance with at least one embodiment, an individual can use the swing training system to perform a stroke to simulate striking a golf ball on the surface. The movement path of the device over the pad is visually illustrated by the reaction of the light source with the light-reactive material such that the individual can observe the actual stroke direction and alignment indicated by the light source path. The visual representation of the actual path fades in a short amount of time such that the individual can perform subsequent strokes in order to improve the correspondence between the actual stroke and the optimal stroke.

20 Claims, 10 Drawing Sheets

2-2
100
101
99
102
104
106
107
108
110
114
116
118
103
2-2

100
see Fig. 6
124
102
99
104
107
106
120
see Fig. 3
108
125
110
128
112
103

SWING TRAINING DEVICE

CROSS-REFERENCE TO RELATED APPLICATIONS

The present application claims priority to U.S. provisional patent application No. 61/722,915, filed on Nov. 6, 2012, which is hereby incorporated by reference in its entirety herein.

FIELD OF THE INVENTION

The present invention generally relates to swing training devices, and more specifically, to a swing training device that utilizes multiple light beams to provide immediate feedback to the user.

BACKGROUND OF THE INVENTION

A variety of different practice methods and devices have been developed in order to improve one's golf swing. These methods and devices focus on various physiological aspects of the golf swing, including body position, body alignment, swing path, and follow-through. However, the presently available devices are limiting in their ability to provide comprehensive feedback on a complete and realistic swing.

Of the methods and devices presently available, the majority of them focus on the body alignment of the user in an attempt to help the user strike the ball in a desired direction. While presently available methods and devices provide feedback on the user's body alignment by analyzing swing path, they often require the user to lift or turn his or her head during the stroke in order to receive the feedback. This can interfere with the user's body alignment during the stroke. Additionally, none of the current methods or devices provides feedback for all of the various movements of the stroke, including the back swing, down swing, contact, and follow-through.

One of the most widely regarded teaching lessons in the game of golf is to teach a golfer to swing within a single plane starting with their backswing, forward swing and follow through. This teaching lesson has been widely regarded for decades as the most ideal golf swing, which has been taught by golf professionals for years. One of the most highly respected and decorated golfers of all time, Mr. Ben Hogan, taught this in his classic book, *Ben Hogan's Five Lessons* (1957), the need for golfers to swing within a plane, but "being consciously attentive to [the plane] does not help . . . "

Therefore, it is desirable to develop a method or device that provides feedback to the user in a manner that allows the user to keep his or her head still during the stroke and swing within a plane, one of the most highly regarded ideal swing characteristics. Also, the device should provide feedback for the entire motion of a stroke. Lastly, the device should be easy to use, durable, and easily stored.

SUMMARY OF THE INVENTION

In accordance with at least one embodiment of the present invention, an improvement over the prior art of swing trainers is presented in part because it provides feedback without the user having to alter their head position, provides feedback for all the movements of a stroke, and can be easily used and stored. The present invention enables a user to obtain immediate feedback on their body alignment by comparing their actual body alignment with the suggested "ideal alignment". Furthermore, the swing training system enables a user to practice swinging within a plane, which is highly regarded as an ideal swing path. Furthermore, at least one embodiment of the present invention is well suited to train a user to swing in a single or multiple planes, which is regarded as an advantageous method for striking a golf ball.

In accordance with at least one embodiment of the invention a swing training system having a surface formed of a photoreactive indicating material is provided. Additionally, a swing training device comprising an indicator adapted for movement over the surface, wherein the swing training device is capable of interacting with the photoreactive surface to form a visual representation of the path of the swing training device is provided.

In accordance with at least one embodiment of the present invention a golf swing training device includes a handle operatively connected to an indicator through a shaft, the indicator having a plurality of UV light sources capable of interacting with a photoreactive surface adapted to provide an indication of movement by the device, a first laser light source positioned to direct a beam of light extending on a center axis of the shaft, and a centrifugal power switch for activating the plurality of UV light sources.

Other aspects, advantages and features of the present invention will be made apparent from the following detailed description taken together with the drawing figures.

BRIEF DESCRIPTION OF THE DRAWINGS

The drawings illustrate the best mode currently contemplated for practicing the present invention.

In the drawings.

DETAILED DESCRIPTION OF THE INVENTION

The various features and advantageous details of the subject matter disclosed herein are explained more fully with reference to the non-limiting embodiment described in detail in the following description.

Figure 1:
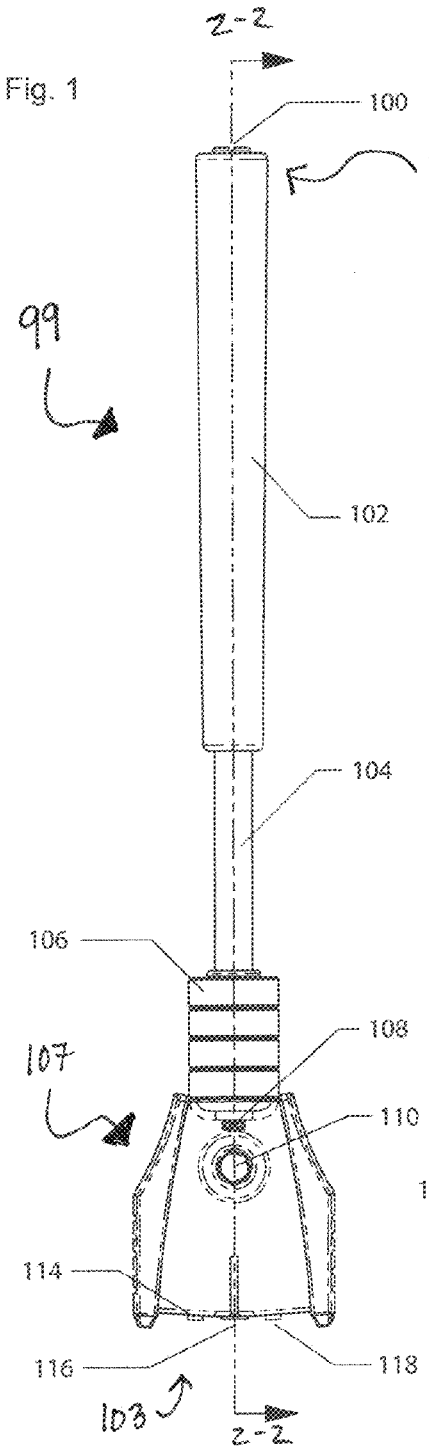
FIG. 1 is a perspective view of a swing training device in accordance with at least one embodiment of the present invention.

Referring to FIG. 1, a swing training device is illustrated generally at 99. The device 99 includes a battery cage 100, a handle 102, a shaft 104, swing weights 106, and indicator 107. The indicator 107 includes a USB port 108, power switch 110, first and second light source 115, 119, and third light source 116. An exploded cross sectional view of the battery cage 100 is more specifically shown in FIG. 6. The handle 102 is operatively connected to the shaft 104. The handle 102 can be selected from a group of grip styles including a golf club grip of various shapes and constructions available on the market, a tennis handle grip, a hockey stick grip, baseball bat grip, or any other grip operatively attached to a device suitable for swinging, including alternative sporting devices. The shaft 104 can be constructed of any suitable material designed to operatively connect the handle 102 to the indicator 107. The shaft 104 can be ⅝ inch copper tubing, graphite, titanium, steel, aluminium, any selected golf club shaft, or alternatively may be a telescoping such that the length of the device 99 can be extended to suit a particular users' preference. When turned on by the on/off power switch 110 is capable of directing light sources 115, 119 such that when passing over a photoreactive surface 48 (See FIG. 8) a visual representation of the path of the swing of the device is formed.

The distance between the first light source 115 and the second light source 119 is approximately 1¼ inches, with the third light source 116 centered between them. Alternatively, the distance between the light sources 115, 119 may be between 1-2 inches. Alternatively, the distance between the light sources 115, 119 may be between ½ and 1 inch apart. In yet another alternative embodiment the distances between the light sources is less than ½ inch or greater than 2 inches. Alternatively, the device 99 can be constructed (not shown) in such a manner as to allow the user to modify the distance between the light sources 115, 119 while allowing them to continue to be directed on a parallel path to the axis of the shaft 104. Alternatively, the weights 106 may be removable to suit the particular users swing weight.

The first and second light sources 115, 119 include a focusing lens 114,118 and diode 117, 121. The light sources 115, 119 can be selected from a variety of suitable commercially available light sources. By example, the light sources 115, 119 can be a 405 nm, 5 mw UV laser. Alternatively, the light sources can be a 650 nm, 200 nm UV laser. In yet another alternative embodiment the light source 115, 119 can be less than 405 nm and less than 5 mw, or greater than 405 nm and greater than 5 mw. Such suitable light sources include those UV laser diodes commercially available from manufacturers such as Thorlabs (www.thorlabs.com) and Roithner Laser Technik (www.roithner-laser.com. Additionally, the light source 115,119 can be selected in combination with the particular photoreactive material utilized with the surface 48 to maximize the photoreactive qualities suitable for the purpose of a swing training device using known in the art reactive characteristics. Alternatively, the surface 48 may be constructed from florescence, phosphorescence, or alternative light reactive material, such that as a light source interacts with it, the surface 48 will provide a temporary indication to the user of the device 99. The reactive surface 48 may alternatively be a painted surface. The surface 48 may include a photo reactive surface when combined with a light source visually indicates the path of a swing from about ½ second to 3 seconds, or preferably about 1, 2 or 3 seconds. Alternatively, the surface 48 can present a temporary visual indicator of the swing path for greater than 3 seconds.

The third light source 116 is a laser that is directed upon the center axis of the shaft 104 and includes a laser module 112. The third light source 116 may be a red laser having a single focused light beam or be presented in the form of a 'crosshair' shape. The third light source 116 can be selected from a variety of commercially available laser diodes and is generally suitable for directing an indicating light up at least up to about 1 foot beyond the indicator 107.

In utilizing the training wand 32 to perform a stroke, an individual grasps the handle 36 and moves the training wand 32 in a generally pendulum-like fashion to simulate a golf stroke within a plane. The golf stroke may include one or more planes, such as a slightly different plane for the backswing as for the downswing.

Figure 2:
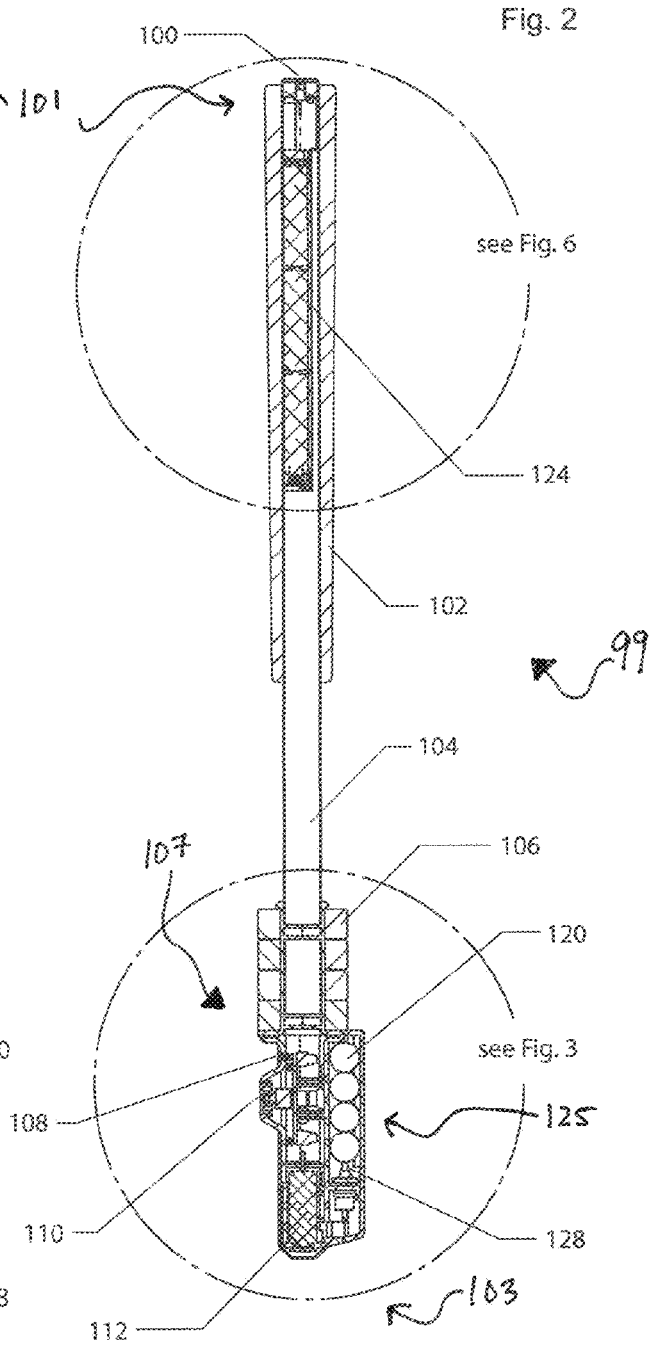
FIG. 2 is a cross sectional view of the swing training device of FIG. 1 taken along line 2-2.

FIG. 2 represents a cross sectional view of the device 99 shown in FIG. 1 along lines 2-2. The indicator 107 is expanded and represented in FIG. 3, while the end of the device 99 having the battery cage 124 is expanded in FIG. 6. A centrifugal power switch 125, also referred to as a centrifugal power mechanism 125, is provided for activating the first and second light sources 115, 119. The power switch 125 includes a plurality of ball bearings 120 enclosed within a case 144 and an activation switch 128. As the device 99 is rotated or swung generally around an axis proximal to the first end 101 the indicator end 103 accelerates, causing the bearings 120 to press upon the switch 128, thereby activating the first and second light sources 115,119.

Figure 3:
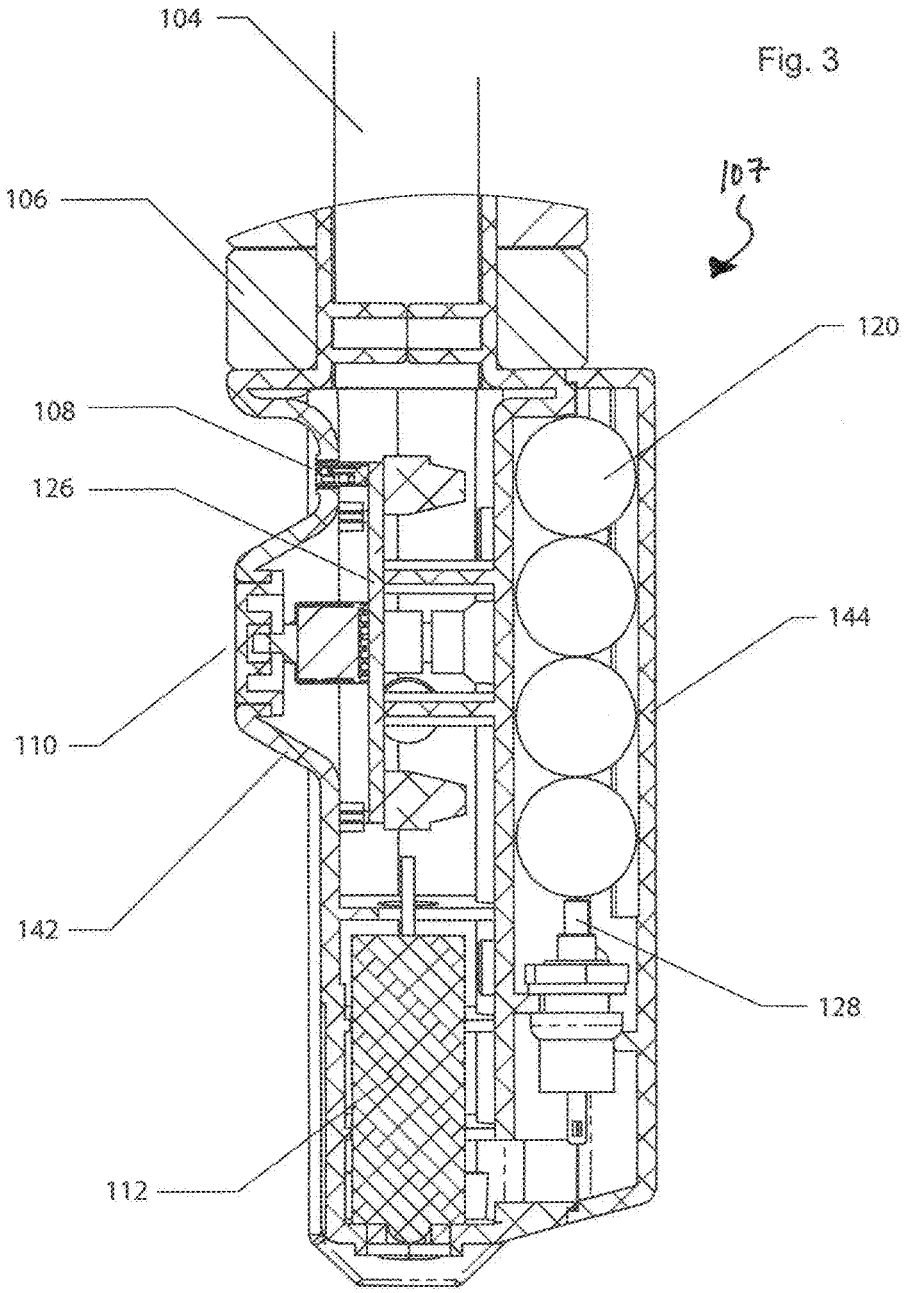
FIG. 3 is an expanded view of the swing training device of FIG. 2.
Figure 4:
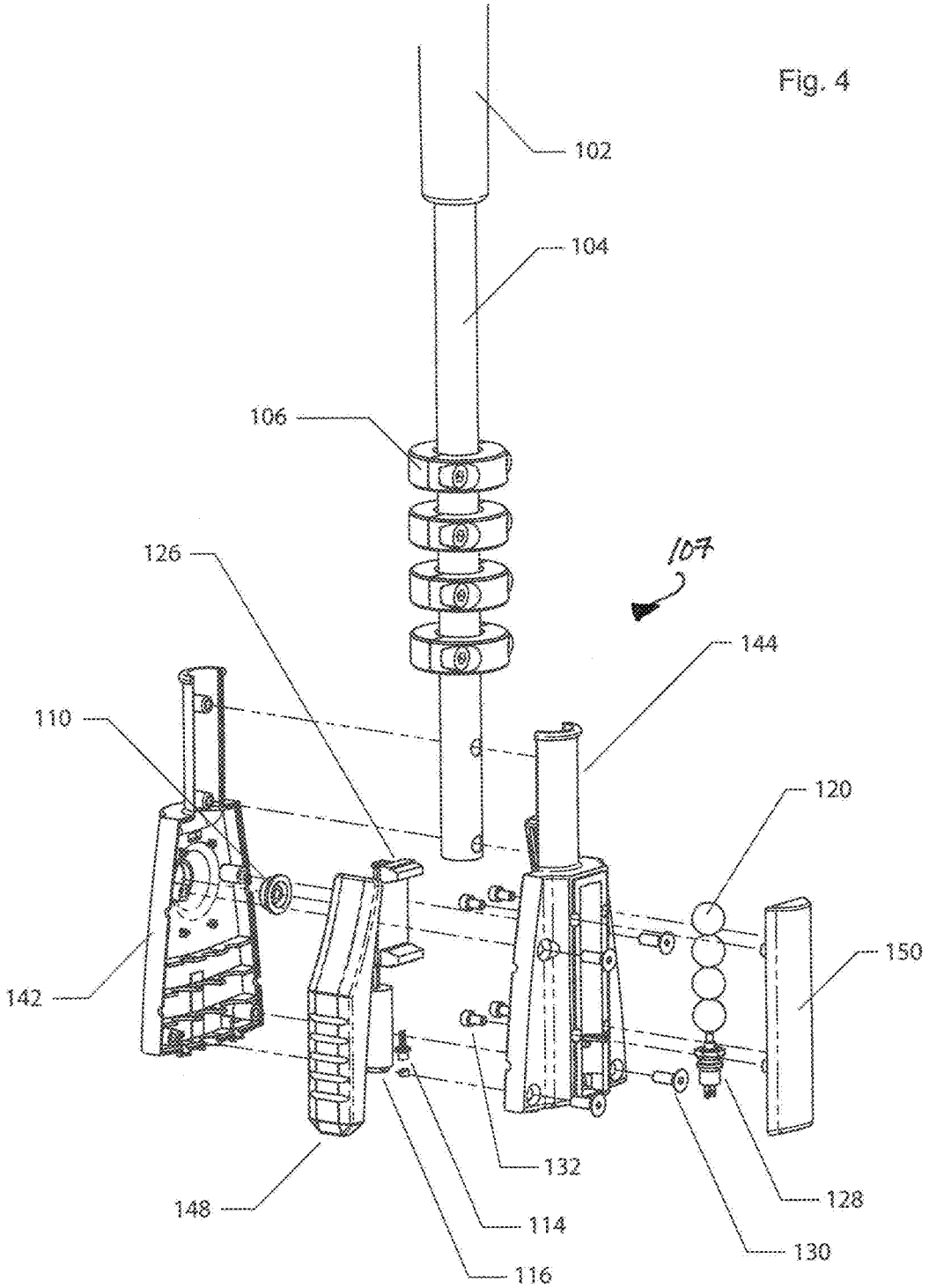
FIG. 4 is a perspective exploded view of the swing training device of FIG. 1.
Figure 5:
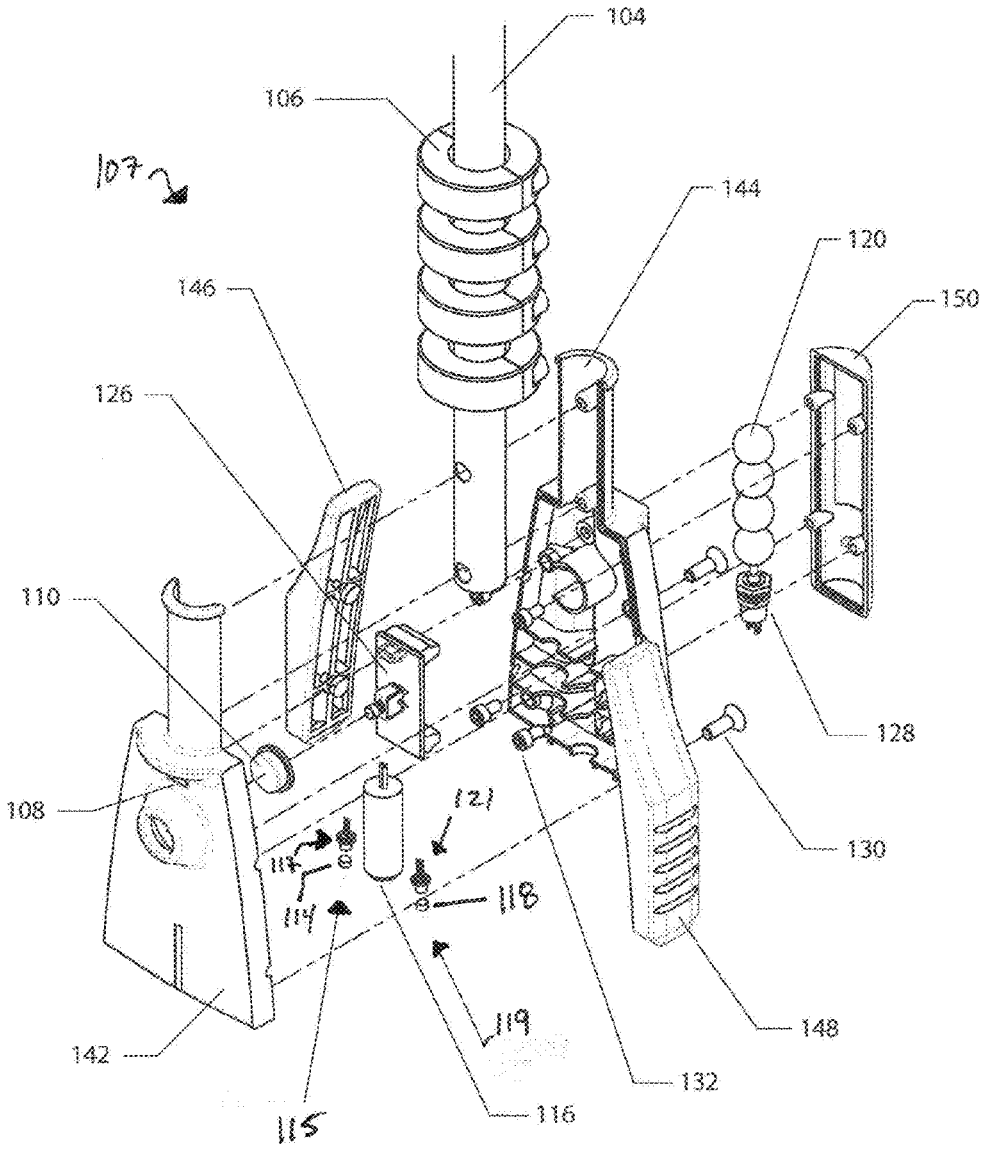
FIG. 5 is an alternative perspective exploded view of the swing training device of FIG. 1.

Referring to FIGS. 3-5, the USB, or alternatively mini-USB port, 108 is provided as a means for charging and/or data transfer. The laser module 112 is present, which can be selected from a range of commercially available light sources. The module 112 is capable of producing a light stream, cross-hair, or alternative configuration of light indicia for the user to align the device 99 for purposes of practicing a swing. The printed circuit board 126 is also identified for enabling proper function of the device 99, including the transfer of power to the light sources during the swinging motion and otherwise. An outer structural piece 142, side piece 148, cover 150, and end piece 144 of the indicator 103 form a portion of the outer structure of the head 103 of the device 99. Bolts 130, 132 are used to secure the various pieces of the head 103.

Figure 6:
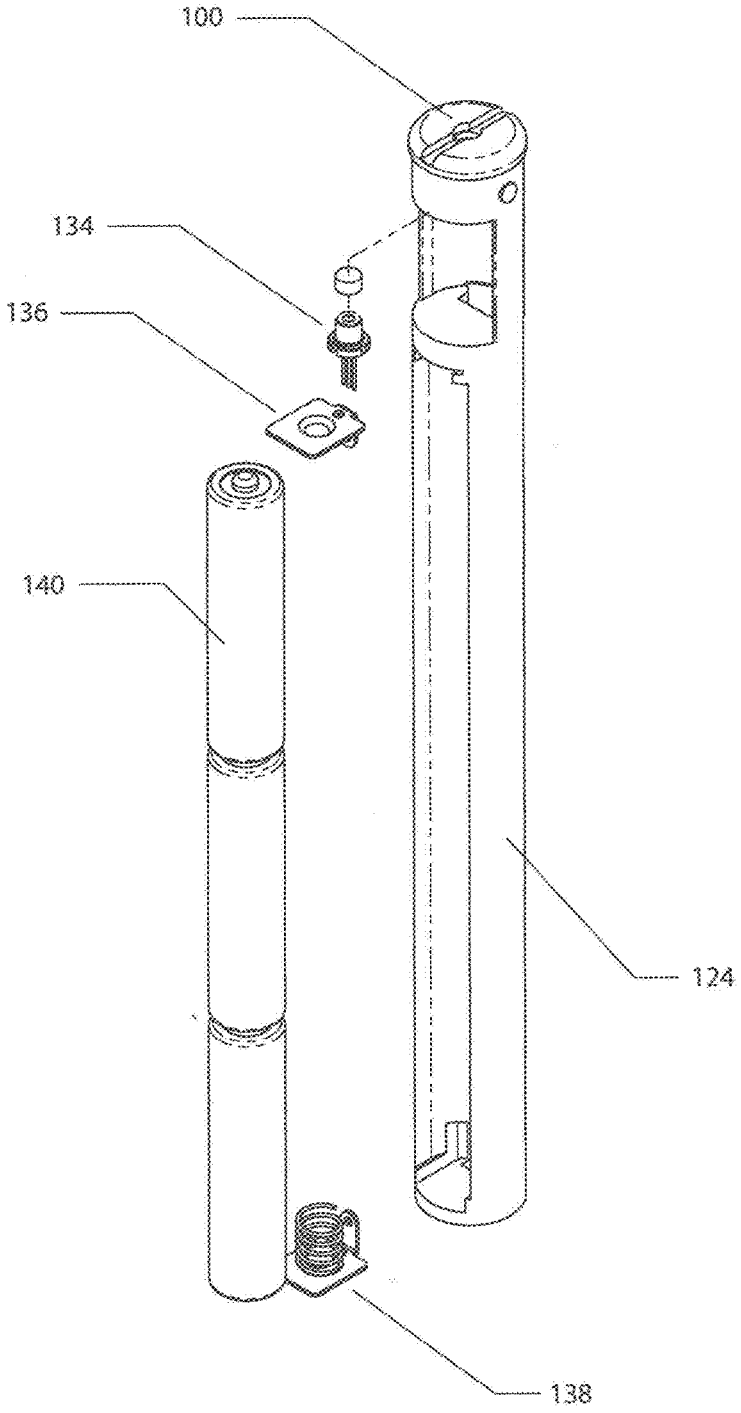
FIG. 6 is an expanded and exploded view of the battery cage end of a swing training device in accordance with at least one embodiment of the present invention.

Referring to FIG. 6, a battery cage 100 is provided with a power means 140. A laser diode 134 and battery contacts 136, 138 are provided. The power means 140 can be a replaceable battery, rechargeable battery, or alternative means for storing and providing power to operate the device 99. The laser diode 134 enables the user to identify their swing path during the backswing of a golf swing. As the swing extends backwards the light generated by the diode 134 will become visible on the surface 48.

Preferably, to train an individual utilizing the training wand 32 or device 99 to swing in a manner consistent with striking a golf ball in a correct and consistent manner, notably within a plane, the training wand 32 is utilized in conjunction with an indicating surface 48.

The indicating surface 48 can be any desired shape or size, but representatively may be a generally rectangular shaped pad 42, for example, with a width of one foot and length of four feet although other dimensions may be employed as desired. In alternative embodiments, the indicating surface may be applied or painted directly onto a floor or wall. Alternatively, the surface 48 can be symmetrical, thereby allowing for left and right-handed golfers. In one embodiment, the pad 42, which carries the indicating surface 48, may be formed with an upper member 44 and a lower member 46 joined to one another by any suitable bonding or securing means such as an adhesive (not shown). However, the pad 42 can also be formed solely from the upper member 44, or can have the upper member 44 material applied to both sides of the pad 42. The lower member 46 is formed of a flexible, and preferably, high-friction material such as a foamed thermoplastic that can be positioned on a flat surface on which the training aid 30 is to be utilized. The thickness of the lower member 46 can vary as desired but may be, for example, between 1/32 and 1/4 inches. The surface 48 may be constructed from any material known, whether commercially available, that is reactive to a light source. Alternatively, the device 32 may be used in conjunction with a surface that is not reactive to light. Alternatively, the device 32 may have a plurality of light sources with varying intensities and wavelengths ranging from 200-400 nm. In yet another alternative embodiment, the device 32 may have a plurality of light sources with less than 200 nm and greater than 400 nm wavelengths and intensities. In yet another alternative embodiment, a first light source 115 may be pulsing while a second light source 119 may be continuous to give the user a further indicator as to they nature of their swing. Alternatively, both light sources 115, 119 may be pulsing at the same rate or at different rates. Alternatively, there may be more than two light sources that are reactive with the surface 48.

The upper member 44 includes or may be formed of an indicating material forming the indicating surface 48, which is capable of visually illustrating the path the training wand head 38 or handle 36 takes when the training wand 32 is utilized to simulate striking a golf ball. In one embodiment, the indicating material forming indicating surface 48 is a phosphorescent or photoluminescent material that, when contacted by a light source, is energized when exposed to the light source, emanating from the training wand head 38 or handle 36, and presents a visual representation 50, as seen in FIGS. 11-14, of the path of the training wand head 38 or handle 36 over the material 48.

The upper member 44 may also include indicia 52 printed or otherwise applied to the indicating surface 48 of the upper member 44, so as to be visible from above. The indicia 52 may be in the form of an image of a golf ball in the center of the upper member 44, and stroke guidelines showing the "ideal path". Instructions of use may also be printed in a discrete location, such as a corner of the pad 42. Indicia 52 can also have other markings optionally included, such as a lines (not shown) illustrating how far to move the head 38 from the initial setup position when swinging from certain distances, or other types of indicators.

Figure 7:
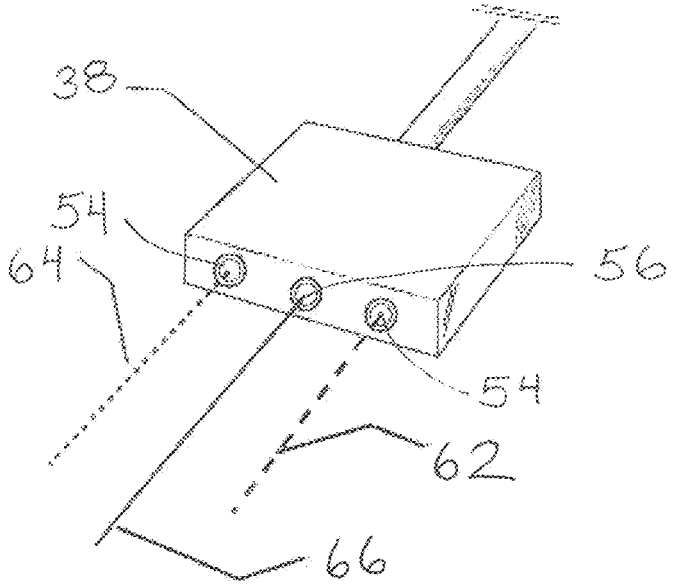
FIG. 7. is a perspective view of the head region of a swing training device showing multiple light beams emanating from the head region in accordance with at least one embodiment of the present invention.

Referring to FIG. 7, the indicator 38 of the training wand 32 contains a plurality of light sources, which may be in the form of one or more indicators 54 and/or red laser diodes 56, a power switch 58, a circuit board (not shown), a centrifugal switch 60, and wiring (not shown). The one or more indicators 54 on the training wand 32 can be any type of indicator capable of interacting with or energizing the indicating material 48 of the pad 42 in order to provide a visual representation of the path of the device head 38 or handle 36 over the pad 42.

Figure 8:
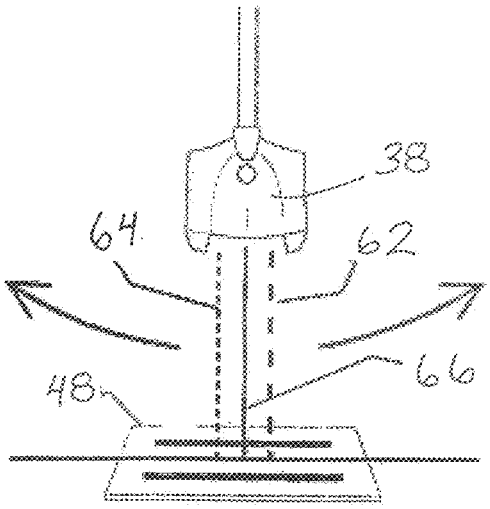
FIG. 8 is a front elevation view of the training device in accordance with at least one embodiment of the invention, in use with an indicating surface where the multiple light beams from the head region contact the indicating surface.

Referring to FIGS. 7 and 8, and referring first to FIG. 7, in one embodiment, the one or more indicators 54 may take the form of a light source which emits a beam of light 62, 64 that upon striking the indicating surface 48, as seen in FIG. 3, causes the material of indicating surface 48 to react and form a visual representation of the path of the device head 38 thereon. The light source can be any suitable light source, such as an ultraviolet (UV) laser, for reacting with the indicating surface 48. The first and second light sources 115, 119 can be alternative light sources that react with a surface 48 to provide a temporary visual indication of a swing path.

Figure 9:
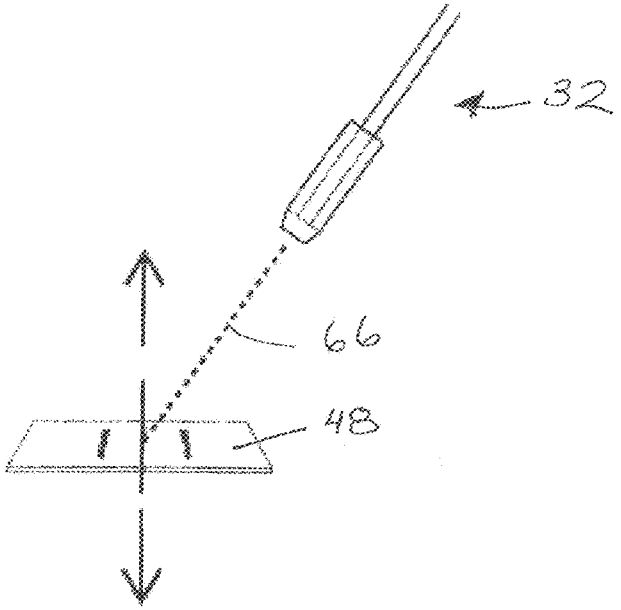
FIG. 9 is a side elevation view of a the training device of FIG. 7 in use with an indicating surface where the red light beam from the head region contacts the indicating surface.
Figure 10:
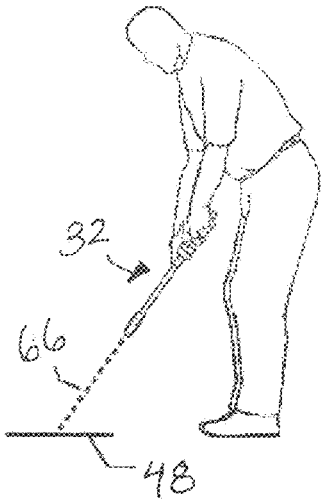
FIG. 10 is a side elevation view of the training wand of FIGS. 1 and 7 held by a user above an indicating surface, where a light beam from the head region contacts the indicating surface of the alignment path.
Figure 11:
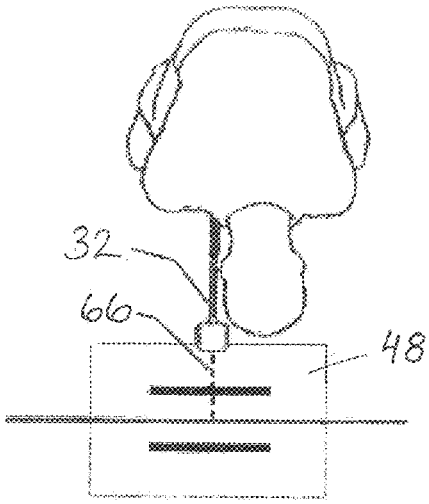
FIG. 11 is top plan view of the training device of FIG. 10, showing the red light beam contacting the indicating surface to create a guide path.

Referring to FIGS. 9-11, in one embodiment, a red laser diode 56 in the head 38 is always ON when the device is powered ON by the power switch 58, and emits a red laser beam 66. This allows the user to align himself or herself and the device before practicing a swing.

Referring to FIGS. 12-15, the handle 36 of the training wand 32 also contains an indicator 54, which in one embodiment is a UV laser. In this embodiment, unlike the indicators 54 in the head 38 of the training wand 32, the indicator 54 in the handle 36 is always ON when the device is powered ON by the power switch 58, and emits a light beam 68 from the handle 36. This allows the user to receive a visual representation of their back swing, down swing, and follow-through.

Figure 16:
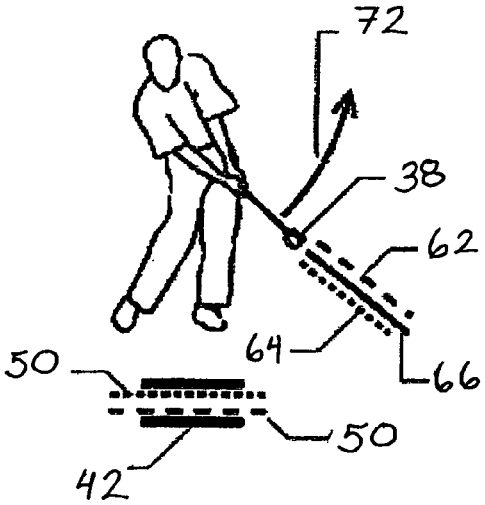
FIG. 16 is a side elevation view of a user holding the training wand of FIG. 6 over an indicating surface, showing two UV light beams and one red light beam emanating from the head region and contacting the indicating surface during contact with the ball.

Referring to FIG. 16, the indicators 54 in the head 38 are UV lasers and are only ON when the centrifugal switch 60 is turned ON from the swinging motion of the training wand 32. In another embodiment, the indicators 54 in the head 38 of the device are controlled by an accelerometer. This allows the user to receive a visual representation of their swing during contact with the ball.

Having described the construction of the training wand 32, the use of the training wand 32 will now be discussed. When using the swing training device 30, the pad 42 is positioned on a relatively flat surface, such as a floor, with the indicating surface 48 placed in an upwardly facing position. The training wand 32 is held by the individual such that the indicators 54 located in the training wand head 38 are perpendicular to and facing the pad 42. When it is desired to operate the training wand 32, the power switch 58 is activated. The individual can then line up the training wand head 38 accordingly with the indicia lines 52, in a proper position and proceed to take a stroke whereby the training wand head 38 is moved rearwardly and forwardly in a plane, as seen in FIGS. 8-9. The plane may be different dependent upon the particular user, and the device 99 need not be altered for users of all shapes and heights to utilize it for purposes of proper swing training.

Referring to FIGS. 9-11, at the beginning of the stroke, the red laser 66 is activated and used to align the stroke properly.

Also at the outset of the stroke, the UV light 68 of the handle 36 is activated to provide feedback on the back swing and down swing of the stroke. As seen in FIG. 11, during the back swing and down swing, the head UV lights 62 are then activated by the centrifugal switch 60 or accelerometer. The training wand head 38 moves across the pad 42 and the light beams 62 from the indicators 54 strike and energize the indicating material 48, causing the indicating surface 48 to "glow". Finally, the UV light 68 of the handle 36, provides feedback on the follow-through of the stroke.

Figure 12:
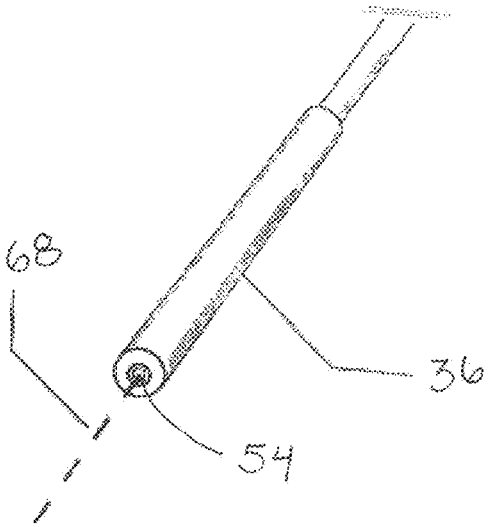
FIG. 12 is a perspective view of the training device handle of FIG. 1, showing a light beam emanating from the handle.
Figure 13:
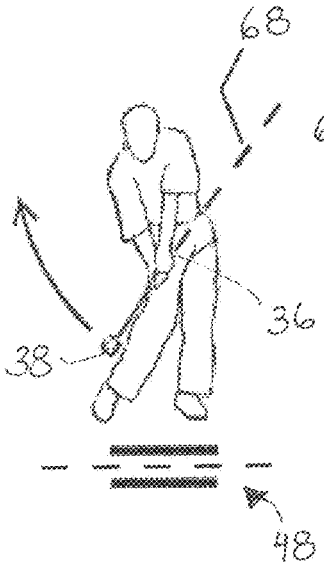
FIGS. 13-14 is a side elevation view of a user holding the training device of FIG. 1 over an indicating surface, showing a light beam emanating from the device handle during the back swing.
Figure 14:
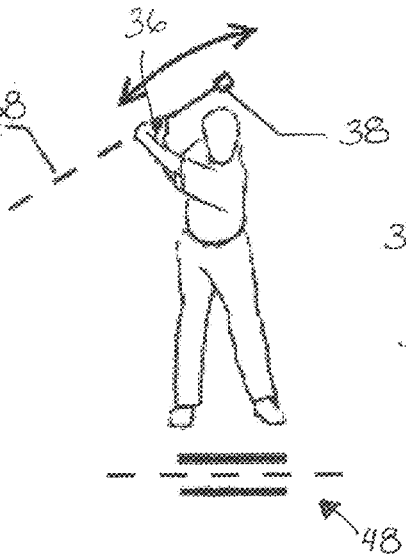
Figure 15:
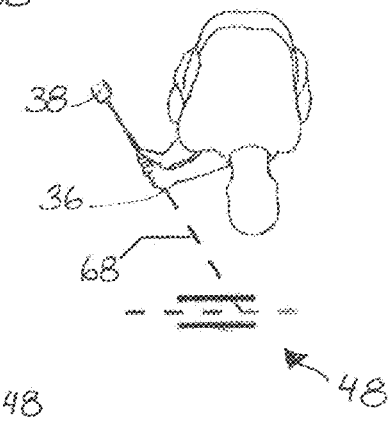
FIG. 15 is a top plan view of a user holding the training device of FIG. 1 over an indicating surface, showing the light beam emanating from the device handle and contacting the indicating surface during the back swing and down swing.

After the completion of the stroke, the indicating surface 48 provides a temporary visual representation 50 of the path of the training wand head 38 or handle 36 over the pad 42, thereby showing the user the path of their actual stroke. This representation of the path can then be compared with the indicia 52 on the indicating surface 48 illustrating the "ideal stroke" path, such that the user can determine how close the actual stroke was to the "ideal stroke," as seen in FIGS. 12-14.

Figure 17:
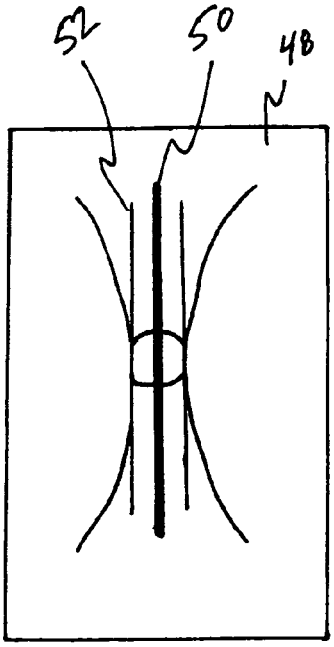
FIGS. 17-19 are top plan views of the indicating surface showing a visual representation of the path of a golf swing compared to preexisting indicia.
Figure 18:
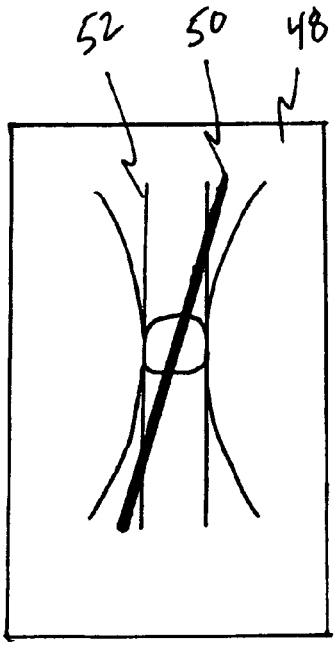
Figure 19:
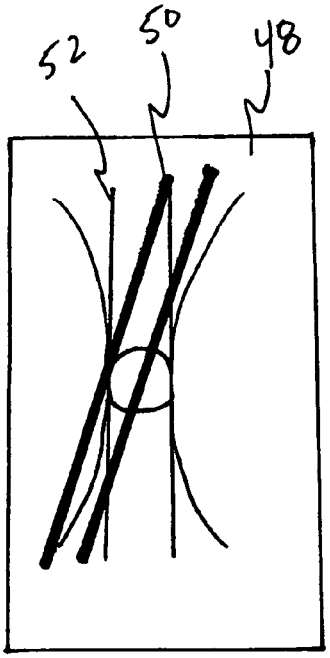

Referring to FIGS. 17-19, and referring first to FIG. 17, the indicating surface 48 shows the temporary visual representation 50 in line with the indicia 52, indicating a proper swing. When the back swing is performed properly, the indicator 54 from the handle 36 of the training wand 32 will make a line in the same spot as the line from the indicators 54 on the head 38 of the training wand, thus making all three lines appear as one. FIGS. 18 and 19 show the temporary visual representation 50 out of alignment with the indicia 52, indicating that the actual path of the swing varied from the desired path represented by indicia. If the head 38 is rotated, the two indicators 54 in the head 38 of the training wand 32 will make two lines. Or, if the back swing is performed improperly, the indicator 54 from the handle 36 will not line up with the indicators 54 on the head 38. In order to distinguish the three lines left on the indicating surface 48 from the three different UV lasers, each UV laser emits a different pattern or shape of beam such as shown at 62, 64, 68.

With respect to the particular type of light utilized with the light source, the particular form of the material of indicating surface 48 will dictate the type or wavelength of light that can be used. More specifically, the frequency of the light beam 62, 64, 68 emitted from the light source must be higher than the frequency of light required to energize or charge the phosphorescent or luminescent material contained within the material of indicating surface 48. In one embodiment, the light emits a beam 62 with a wavelength of less than about 500 nanometers. The red laser diode 56 emits a different, non-activating, beam 66 with a wavelength of approximately 600-700 nanometers, which is used to align the device before the swinging action of the training wand 32.

After the user has compared the actual path to the "ideal path," the visual representation 50 on the indicating surface 48 fades as the material becomes de-energized, thus allowing the indicating surface 48 to form a subsequent visual representation 50 during a subsequent stroke. The user can thus practice the strokes repeatedly to create the desired muscle memory for use during an actual golf game.

The training device 30 can be utilized in this manner for a large number of strokes because the pad 42, and specifically the material of indicating surface 48, can be successively de-energized and re-energized by the light beams 62, 64, 68 almost indefinitely. Furthermore, in order to maximize the visual representation 50 of the actual stroke on the pad 42, the training device 30 should be utilized in a low light condition where the indicia 52 is still easily viewable on the pad 42, but such that the visual representation 50 created by the indicator 54 moving over the pad 42 is easily viewable in contrast to the indicia 52.

The present invention contemplates any embodiment in which an indicator 54 is capable of interacting with the indicating surface 48 in a manner that temporarily represents the path of the training wand 32 over the indicating material 48. Also, a small amount of contact between the training wand 32 and indicating surface 48, which does not impede the stroke, is also contemplated. For example, the material of indicating surface 48 could be heat-sensitive material that locally changes color when contacted by a heat source, and the indicator 54 could be formed as a small heat source and moved over the heat-sensitive indicating surface 48. Further, the indicator 54 could be formed of a dry erase marker (not shown) or similar writing implement. When the training wand 32 is moved over the indicating material, it causes the indicator 54 to scribe a line (not shown) representative of the training wand head 38 path on the indicating surface 48.

Figure 20:
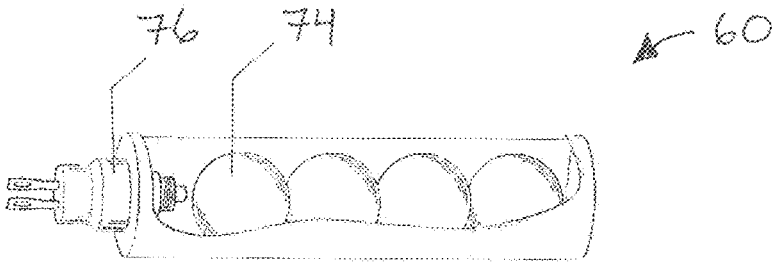
FIG. 20 is cut away side elevation view of a centrifugal switch located within the training wand, showing the switch when it is at rest.

Referring to FIG. 20, weights 80 made of an appropriate material and fastening means can be added to or removed from the club shaft 34 when the shaft is not attached to the handle 36 to achieve the proper swing weight depending on what club weight feels realistic to the user.

The exterior of the club head 38 can be covered with any suitable shock-absorbing material which allows for protection of the head and its contents. The shock absorbing material also acts as a safety feature if it unintentionally strikes an object.

Figure 21:
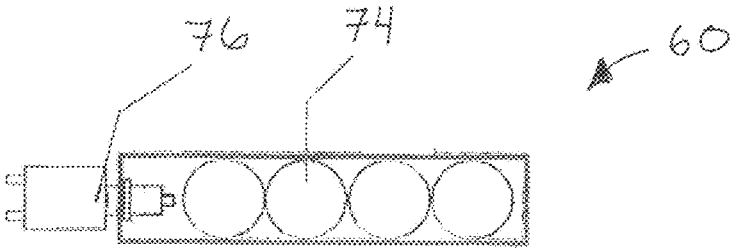
FIG. 21 is a schematic side elevation view of the centrifugal switch of FIG. 17, showing the switch when it is at rest.

Referring to FIG. 21, the shaft 34 of the club is detachable from the handle 36, and can be made out of aluminum or any other suitable material to be light weight while still maintaining strength. The shaft 34 may have an optional additional piece added or removed to adjust the overall length of the training wand 32.

Referring to FIG. 21, the handle 36 or shaft 34 encloses a suitable power source 70 such as a replaceable battery or a kinetic motor. The handle 36 is made to resemble a golf club grip, and is made of a rubber or similar material.

Figure 22:
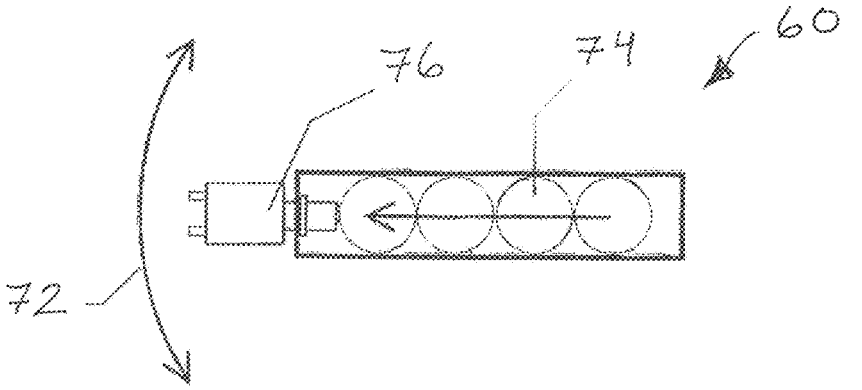
FIG. 22 is a schematic side elevation view of the centrifugal switch of FIGS. 20 and 21, showing the switch when it is activated during a swing motion.

Referring to FIGS. 22-24, the centrifugal switch 60 activates when the user swings the training wand 32 in a direction shown at 72, thereby causing the force of small weights 74 to press down on an internal switch 76. Movement of the training wand 32 in the opposite direction, or cessation of movement of the direction 72, causes the weights 74 to disengage the internal switch 76 and therefore deactivate the indicators 54.

Alternatively, the shape of the training wand head 38 can vary greatly depending upon the particular construction of the device. In yet another alternative embodiment, it is contemplated that the indicator 107 can be attached to the head of a standard golf club and function in the same manner. The indicator 107 can be attached through a varied of known attachment means, including straps, bolds, ties, etc. In yet another alternative embodiment, it is contemplated that the indicator 107 is formed in the shape of a golf club head, including an iron, hybrid, wood, or other suitable golf club head. In such an embodiment, the device is a regular length golf club, having similar look, feel, and weight, in which the light sources are integrated within the club head and allows the device to function as the device 99 provided herein.

While the invention is well suited for use in practicing a golf swing, it is also contemplated that the invention may be used to trace the movement of any type of swing, and is not limited to a golf swing. In addition, it is also understood that the present invention may be used with or without the reference indicia on the pad.

A method for practicing a golf swing using a golf swing training device is contemplated. A user positions a photoreactive indicating material on a surface. The photo reactive material can be a thin coating such as layer of photoreactive paint applied directly to a flooring surface. Alternatively, the photoreactive material is a layer of a mat layed upon a flooring surface. The user positions themselves in close proximity to the indicating material while grasping a golf swing training device 99.

The golf swing training device is activated by the user, wherein the golf swing training device includes a plurality of light sources. Additionally, at least two of the plurality of light sources are capable of interacting with the photoreactive indicating material. The user swings the golf swing training device such that at least two of the plurality of light sources pass over the indicating material, wherein the indicating material and at least two of the plurality of light sources interact with each other to provide a visual representation of the path of the swing device as the swing device is moved over the indicating material. The positioning of the UV light sources through the swinging motion will provide an indication as to whether the user is swinging on the ideal swing plane. Slight rotation or deviation from the swing plane will represent an improper swing.

The user visually inspects of the path of the swing training device with indicia disposed on the indicating material surface, wherein the indicia represent a desired path of movement of the swing device. The indicia may include outlines of an iron or wood, depending upon size, as well as a central indicating line for focused swing training. The user can also swing the swing device with a modified swing path based at least in part upon the visual representation of the first swing.

In accordance with at least one embodiment of the present invention a swing training system which includes a light-reactive surface, and a training device having a light source capable of striking the light-reactive surface and creating a temporary visual representation of the path of the light over the surface. The device can include multiple light sources, which according to the arrangement of the illuminated paths on the surface indicate if the proper alignment was achieved during a swing. In accordance with at least one embodiment, an individual can use the swing training system to perform a stroke to simulate striking a golf ball on the surface. The movement path of the device over the pad is visually illustrated by the reaction of the light source with the light-reactive material such that the individual can observe the actual stroke direction and alignment indicated by the light source path. The visual representation of the actual path fades in a short amount of time such that the individual can perform subsequent strokes in order to improve the correspondence between the actual stroke and the optimal stroke.

In an alternative embodiment, the swing training device includes an alignment pad that is positioned on a flat surface. A golf ball can be optionally positioned on the pad. The pad includes at least an upper surface that is formed of an indicating material, the indicating material has a multitude of guiding indicia for comparative analysis to provide an indication to the user whether they are swinging outside a plane, whether they are following through with an open or closed club face, and whether they are swinging squarely through the impact zone of the ball. The mat may be symmetrical in order to allow for both left and right handed golfers to utilize the tool.

In at least one embodiment of the present invention, the training device also includes an indicator, which may be a training wand having a handle and a head region. The training wand may be the same size or shorter than a standard golf club. The training wand interacts with the indicating material of the pad in order to provide a visual representation of the actual path of the indicator during a stroke. This enables the user to compare the actual to an "ideal path".

In at least one embodiment of the present invention, multiple lasers are used in order for the user to receive feedback on multiple aspects of their stroke. In one embodiment, the head region has a laser, which may be a red laser, which does not activate the indicating surface, and allows the user to adjust the device during the takeaway without leaving any marks on the indicating surface. The head region also has two UV lasers on either side to allow the user to visualize whether the head region was aligned properly during contact of the ball. The UV lasers activate the indicating surface to provide a visual representation of the swing path as the head region moves over the indicating surface. Finally, the handle has a UV laser that allows the user to visualize the back swing, down swing, and follow-through of the stroke. The UV laser activates the indicating surface to provide a visual representation of the handle position as the end of the handle points toward the indicating surface.

In at least one embodiment of the present invention, the use of UV lasers allows the user to have a more precise visual representation than if LED lights were used because they provide a more focused beam of light hitting the indicating surface. The visual representation of the actual path created on the indicating material remains visible for a sufficient amount of time to allow the user to compare their actual stroke with the "ideal stroke". However, the visual representation on the indicating surface fades relatively quickly so that the indicating surface can be reused for subsequent golf strokes.

In another alternative embodiment, the swing training system includes a recording means (not shown) for recording the swing paths of the user using the device 99. The recording means may record the reactive paths of the light sources and provide swing analysis measurements, including speed, and analysis of the incorrect and correct swing paths.

According to another aspect of the present invention, the indicating surface is on an alignment pad, which is formed of a flexible material so that it can be rolled, folded, or otherwise collapsed for storage. The pad may also include a lower surface formed of a material different from the upper surface in order to provide a sturdier support. The pad may also be a thin coating on top of another permanent surface, such as a wall or floor.

Various alternatives are contemplated as being within the scope of the following claims, particularly pointing out and distinctly claiming a subject matter regarded as the invention.

We claim:

1. A swing training system comprising:

a surface formed of a photoreactive indicating material; and a swing training device comprising an indicator operatively connected to a handle, the indicator adapted for movement over the surface, the indicator comprising a first light source and a second light source directed on a parallel path with the shaft and a third light source centered between the first light source and the second light source, wherein the first and second light source are capable of interacting with the photoreactive surface to form a visual representation of the path of the swing training device and the third light source is configured for alignment of the device without activating the indicating material.

2. The swing training system according to claim 1, wherein the first and second light sources are movable and configured to modify the distance between the first and second light source.

3. The swing training system according to claim 2, wherein the first and second light source are configured to activate upon swinging the device.

4. The swing training system according to claim 2, wherein the first and second light source is a UV laser.

5. The swing training system according to claim 2, wherein the third light source is a red laser configured to form a visual representation of a cross-hair when directed on a surface.

6. The swing training system according to claim 2, wherein the indicating material is a light-reactive material.

7. The swing training system according to claim 2, wherein the indicating material is a phosphorescent material.

8. The swing training system according to claim 1, wherein the first and second light sources are UV lasers capable of reacting with the photoreative indicating material.

9. The swing training system according to claim 8, wherein the swing training system further comprises:

a power switch that activates at least one of the first, second, and third light sources.

10. The swing training system according to claim 9, wherein the power switch is a centrifugal switch compressed by the centrifugal force of a weight when the device is swung.

11. The swing training system according to claim 9, wherein the power switch comprises an accelerometer.

12. The swing training system according to claim 8, wherein the device further comprises a fourth light source positioned on the same axis as the third light source and directed outwardly from a handle.

13. A golf swing training device, comprising:

a handle operatively connected to an indicator through a shaft, the indicator comprising, a plurality of UV light sources capable of interacting with a photoreactive surface adapted to provide an indication of movement by the device and directed on a parallel path with the shaft, a first laser light source positioned to direct a beam of light extending on a center axis of the shaft and configured for alignment of the device, wherein the plurality of UV light sources are movable and configured to modify the distance between the plurality of UV light sources and, a centrifugal power switch for activating the plurality of UV light sources.

14. The golf swing training device according to claim 13, wherein the laser light source and the plurality of UV light sources are positioned in a single plane.

15. The golf swing training device according to claim 13, wherein the plurality of UV light sources is a pair of UV light sources.

16. The golf swing training device according to claim 15, further comprising a second laser light sources positioned proximal to the handle and extending 180 degrees with respect to the first laser light source.

17. The golf swing training device according to claim 13, wherein the plurality of light sources have a wavelength in the range of about 100 to 600 nm.

18. The golf swing training device according to claim 13, further comprising a centrifugal power switch compressed by the centrifugal force of a weight when the device is swung.

19. A golf swing training system, comprising:

a photoreactive indicating surface;

the golf swing training device in accordance with claim 13.

20. A method for practicing a golf swing using a golf swing training device, the method comprising the steps of:

positioning an photoreactive indicating material on a surface;

activating the golf swing training device, wherein the golf swing training device includes a plurality of light sources, at least two of the plurality of light sources are capable of interacting with the photoreactive indicating material;

swinging the golf swing training device such that at least two of the plurality of light sources pass over the indicating material, wherein the indicating material and at least two of the plurality of light sources interact with each other to provide a visual representation of the path of the swing device as the swing device is moved over the indicating material;

comparing the visual representation of the path with indicia disposed on the indicating material surface, wherein the indicia represent a desired path of movement of the swing device; and swinging the swing device with a modified swing path based at least in part upon the visual representation of the first swing.

* * * * *